US005873188A

United States Patent [19]

Gehris

[11] Patent Number: 5,873,188

[45] Date of Patent: Feb. 23, 1999

[54] IDENTIFICATION BANDS

[76] Inventor: Ned R. Gehris, 2984 Bernville Rd., Leesport, Pa. 19533-9756

[21] Appl. No.: 739,053

[22] Filed: Oct. 28, 1996

[51] Int. Cl.[6] ..... A44C 5/00

[52] U.S. Cl. ..... 40/633; 40/665; 292/307 A

[58] Field of Search ..... 40/633, 665; 283/75, 283/900; 63/3, DIG. 3; 292/320, 325, 328, 307 A; 24/16 PB, 30.5 P

[56] References Cited

U.S. PATENT DOCUMENTS

| | | | |
|---|---|---|---|
| 2,898,602 | 8/1959 | Moss | 63/3 X |
| 3,973,610 | 8/1976 | Ballin | 24/30.5 P |
| 4,285,146 | 8/1981 | Charles et al. | 40/633 X |
| 4,783,917 | 11/1988 | Smith et al. | 40/633 |
| 5,704,097 | 1/1998 | Rahar | 40/633 X |

*Primary Examiner*—Brian K. Green
*Attorney, Agent, or Firm*—Richard O. Church

[57] ABSTRACT

An identification device is disclosed comprising a display area for recorded indicia that is located between a first and a second end. The first end includes three or more equally spaced apart holes and the second end includes three or more equally spaced holes. The device is an improvement over the prior art in that the equal spacing on the first end is different than equal spacing on the second end by which means closer adjustment of the circumference of the band can be obtained without spacing the securing holes on either end so close together that they may be easily torn.

4 Claims, 3 Drawing Sheets

IDENTIFICATION BANDS

BACKGROUND OF THE INVENTION

1. Field of the Invention

This invention relates to identification devices and more particularly relates to identification bands which are compromised or destroyed when removed. These bands find multiple uses such as for patient and prisoner identification; admission recognition to secured areas as for concerts, exhibits and public affairs; animal tagging; article identification; and other related uses.

2. Definitions

For ease of description and simplicity of understanding, the following terms and definitions are used in this specification and its appended claims:

a. "Band" is used to mean a device bearing identifying indicia adapted to be secured in surrounding relationship to a part of a person, animal or object. In its most common embodiment it is a bracelet that is attached to a wrist of a person and it is in this context that the invention is usually discussed in the following description, though it should be understood that it is not intended that the invention be so limited.

b. "Circumference" is used to mean the perimeter of a band as secured to a person or an object.

c. "Diameter" is used to refer to the diameter of the band as secured to a person or an object.

3. Discussion of the Prior Art

Bands of the sort to which this invention relate are well known and described in the prior art. Conventionally, the bands utilize straps of flexible materials having envelopes or pockets adapted to receive inserts bearing identifying indicia. The exposed portion of the pockets are made from a transparent material so that the indicia remains visible after it has been inserted. While not as secure from accidental or purposeful erasure or alteration, the indicia can be inscribed on the surface of the band as with an indelible ink.

By way of example, hospitals need to provide reliable means to identify patients by name, accounting number or bar code during their stay in the hospital. Ideally, the identification is inexpensive since the article is not reusable, it must be easy to attach to a wrist or ankle, it must be securely fastened and not inadvertently or readily detached, it should be light in weight and finally, it should be comfortable to wear. Reference is here made to U.S. Pat. Nos. 3,020,657, 3,656,247, and 3,965,589 which contain representative descriptions of bands of the general type to which this invention pertains and they are incorporated herein by reference.

It is at once apparent that a band must be snugly attached so that it can not slide off a wrist and over the hand. It is also apparent that the band should not be attached so tightly that it chaffs the wrist, restricts the circulation of blood or otherwise is uncomfortable or annoying to wear.

The bands provided in the prior art most commonly make use either of a crimped fastener or holes in the ends of the bands through which fastening means are inserted. Crimped fasteners have the advantage of being infinitely adjustable, but suffer from the fact that they can be pried loose and removed or exchanged with a different band. However, when holes are positioned at the two ends of a band, locking devices can be used that require destructive removal. These locking devices are usually referred to in this application and claims as "snap locks". They are well known in the art (see, for example the FIG. 4 of U.S. Pat. No. 4,783,917) and are readily available from many sources, as for example, Scovill Fasteners Inc. under its trademark "Tag Lock".

While bands that utilize holes and snap locks are more secure than are crimped bands, they lack the flexibility of crimped bands in adjusting the circumference of the band and how tightly it is drawn down over a wrist or ankle.

When one considers the geometry of the bands, it can be appreciated that small changes in the circumference of a band will result in significant changes in the diameter of the band. Since the relationship between the circumference and diameter of a circle is expressed by the equation $C=\pi(D)$, a variation of only one inch in circumference of a band will alter the diameter of the band by slightly more than five-sixteenths of an inch. This follows from the fact that when C is increased by a distance x, (C+x), then D will increase from $D=C/\pi$ to $D=(C+x)/\pi$ or $C/\pi+x/\pi$. The increase in D is therefore equal to $(C/\pi+x/\pi)$ minus $(C/\pi)$ or simply $x/\pi$. It necessarily follows that if a wrist band is made with attachment holes one inch apart and the band is attached to the nearest hole that is comfortable to wear, the diameter may vary by ±5/16ths of an inch. This variation may be the difference between a band being uncomfortably tight and a band that, with some persuasion, may be slid off the wrist.

It is of course possible to space the attachment holes on a band closer than one inch apart but, as a practical matter, a spacing which is closer than about ⅜ to ½ inch is generally undesirable because of the increased chance of tearing the band between adjacent holes.

SUMMARY OF THE INVENTION

It is, therefore, an object of this invention to provide a band which may be worn comfortably but adjusted to prevent accidental or intentional removal as by sliding the band off a wrist.

It is another object of this invention to provide a band that may be adjusted in its circumference to a length less the distance between the attachment sites on the band.

Yet another object of this invention is to provide a band that has increased adjustability in its fit as around a wrist without spacing the holes (attachment sites) so close to each other that the band may be torn between adjacent holes.

These and other objects of this invention are achieved by placing holes at a first end of the band that are spaced apart at distance different than the distance at which the holes at a second end of the band are spaced apart. When a hole from the first end of the band is aligned over a hole on the second end of the band a snap lock is passed through and engages and secures the holes in their aligned position. When security is important, the snap locks can be of the type that must be destructively removed.

In a preferred embodiment of the invention, when the first end is placed over the second end, at least two holes on the first end will align with at least two holes on the second end and the number of holes separating the two aligned holes on the first end will be one more or one less than the number of holes separating the two aligned holes on the second end. By these means the incremental distance at which the circumference of the band can be adjusted will be the difference of the distance between adjacent holes on the first end of the band and the distance between adjacent holes on the second end of the band.

These and other objects of this invention will be made clearer by a description of the drawings in which:

DETAILED DESCRIPTION OF THE DRAWINGS

Figure 1:
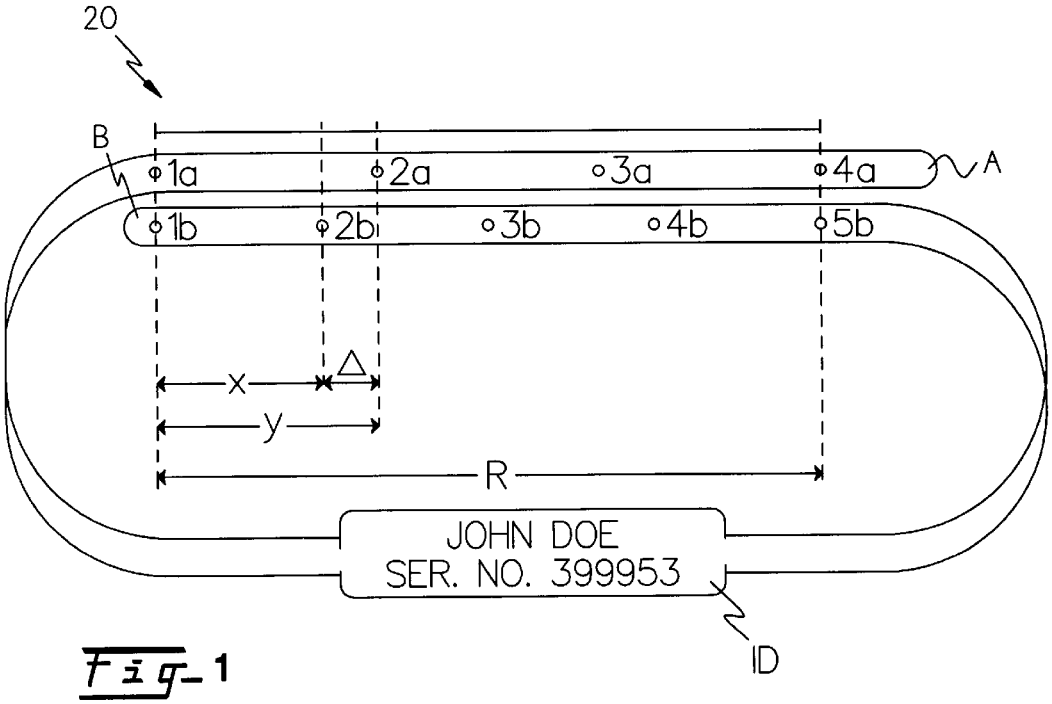
FIG. 1 is a schematic perspective view of a simple form of a band made in accordance with this invention illustrating fundamental relationships of the attachment sites (holes) on each end of the band.

FIG. 1 illustrates in schematic form a band 20 which can conveniently be fabricated from a tough, flexible material. While leather is an acceptable material from which the band may be made, many plastics will prove more useful in terms of toughness and wear and include materials such as polyethylene, polyester, nylon, acetal and the like, all of which are available in strip or sheet form for convenience of fabrication.

The band 20 of FIG. 1 is illustrated as being adapted to be looped and fastened around a patient's limb. Identification information such as a name, an identification number or bar code can be inscribed directly onto the band or, more preferably, for greater security, the identification indicia ID may be placed and sealed in a pocket having a transparent face. See for example the device illustrated in U.S. Pat. No. 3,020,657.

It should be understood that the present invention is not concerned with the method or materials by which the band is fabricated nor with the means used to display indicia on the band. Almost any method known in the art can be used. Rather the invention here described relates to a band which can readily be adjusted to fit comfortably, yet securely, around, for example, a persons' wrist or ankle. This is accomplished by the relationship of the holes on the end portions of a band of this invention.

Figure 6:
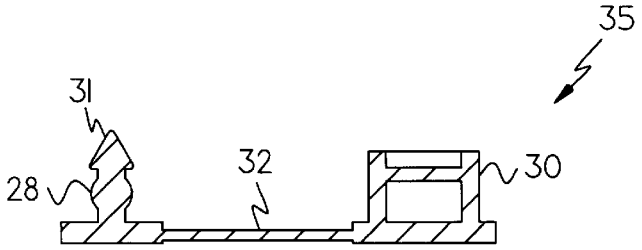
PRIOR ART Fig. 6
FIG. 6 is a cross sectional view of a prior art fastening device useful in the practice in this invention.

As illustrated in FIG. 1 there is schematically illustrated a band 20 having a middle portion ID for displaying indicia and a first end portion A and a second end portion B. The two end portions A and B are adapted to be overlapped and secured with snap locks such as illustrated, for example, in FIGS. 3 through 10 of U.S. Pat. No. 4,285,146. Another fastening device 35 is illustrated in FIG. 6 of the instant application. The fastening assembly 35 is comprised of a male plug assembly 28 which is placed into a female socket assembly 30 in a locking relationship. The male plug assembly 28 is designed with a barbed end 31 that is received in locking relationship by the female socket assembly 30. The male and female ends are connected together by means of a tether 32. The tether assists in keeping the male and female pieces together in pairs for user convenience. For a more complete description of this fastening device, reference is made to FIG. 4 of U.S. Pat. No. 4,783,917.

In FIG. 1, the first end portion A is illustrated with four holes 1*a* through 4*a* each separated by a distance y. The second end portion B of the band 20 has five holes 1*b* through 5*b* each separated by a distance x. The attachment sites 1*a* and 1*b* are shown in overlying registry with each other as are attachment sites 4*a* and 5*b*. It follows that the distance between attachment sites 1*b* and 5*b* is the same as the distance between attachment sites 1*a* and 4*a*. This distance is here referred to as the repeat distance R.

It is apparent that the repeat distance R is equal to the sum of the incremental distances 3(y) on the first end portion A of the band or the sum of the incremental distances 4(x) on the second end portion B of the band. The difference in the incremental distances x and y is indicated on the drawing as Δ. The basis of the invention lies in the fact that there is one less hole in a repeat unit R on one end of the band than there is on the other end of the band 20.

Figure 2:
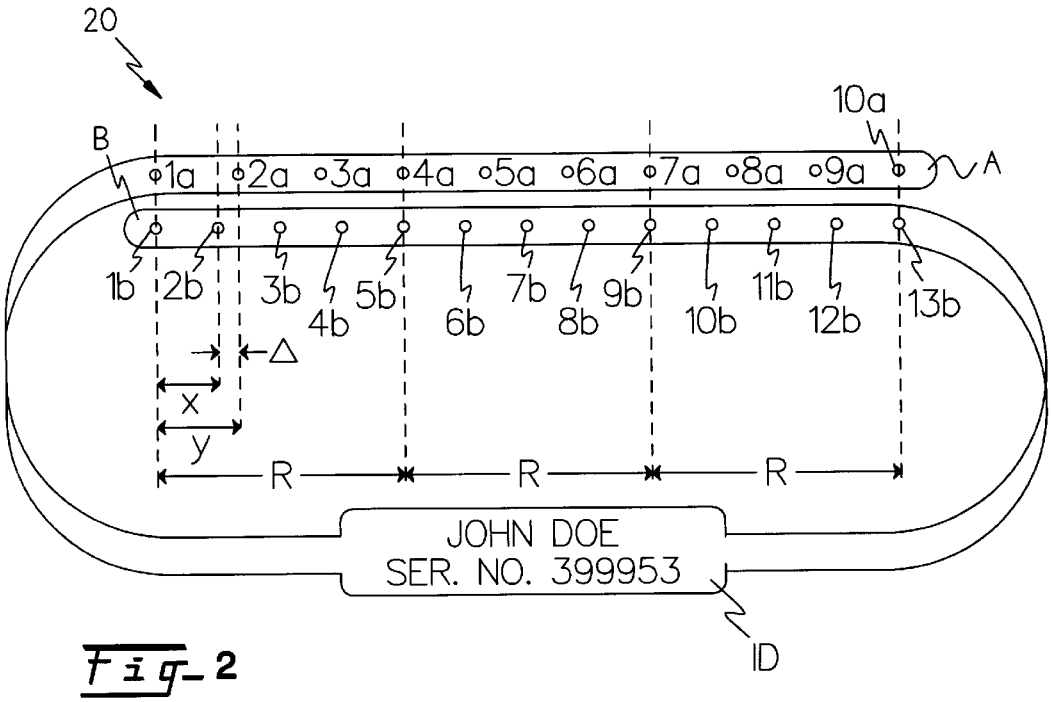
FIG. 2 is a schematic perspective view of the band in FIG. 1 illustrating three rather than one repeating unit.

FIG. 2 illustrates a band 20 similarly configured with the band 20 of FIG. 1 except that three repeat units R are provided. As a result, four snap locks can be used to secure holes 1*a* and 1*b*, holes 4*a* and 5*b*, holes 7*a* and 9*b* and holes 10*a* and 13*b*. While the use of four fastening points is probably excessive, FIG. 2 illustrates that a band can be designed to accommodate a plurality of fastening points.

Figure 3:
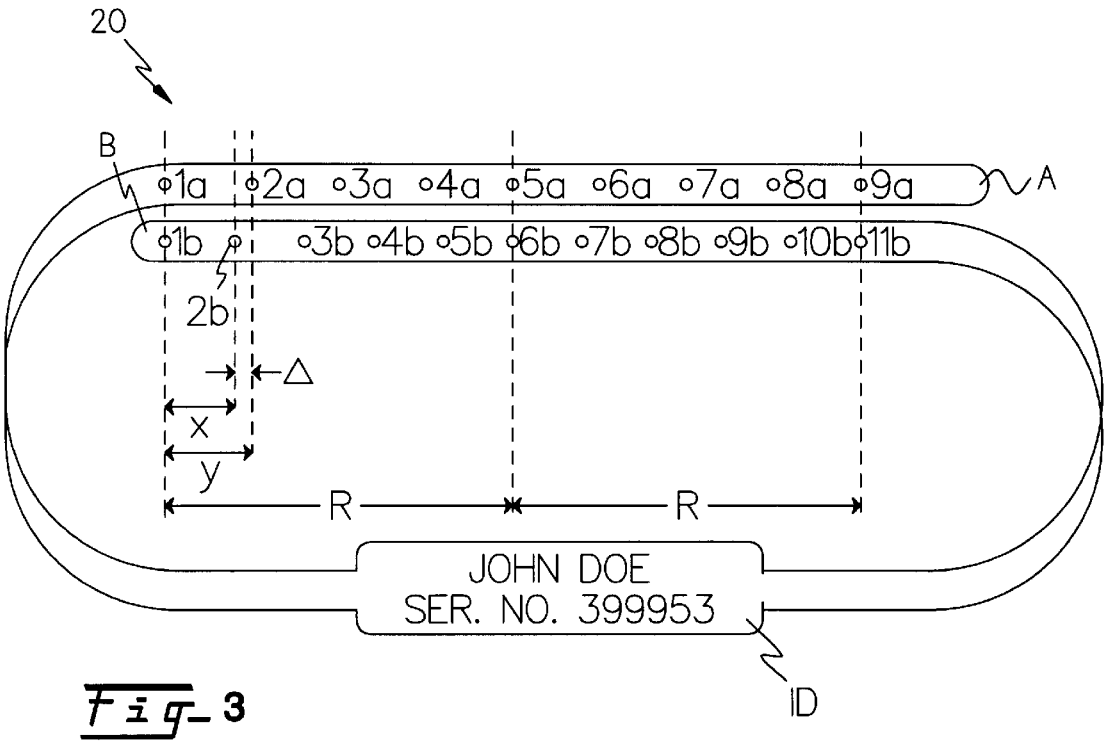
FIG. 3 is a schematic view, similar to the band in FIG. 1, illustrating the use of a different number of holes in the ends of the bands.

The band 20 illustrated in FIG. 3 differs from the bands 20 of FIGS. 1 and 2 in that the number of holes in a repeat unit have been changed. Here the the first end portion A is illustrated with five holes 1*a* through 5*a* each separated by a distance y in a given repeat unit R. The second end portion B of the band 20 has six holes 1*b* through 6*b* each separated by a distance x in a given repeat unit R. The effect of changing the number of holes in a repeat unit in FIG. 3 is to decrease the distance Δ thus allowing greater flexibility in adjusting the circumference C of the band 20. Note, however, that the difference between the number of holes in the repeat units at each end of the band is just one as is also true in the bands of FIGS. 1 and 2. As illustrated, attachment members may be inserted at holes 1*a* and 1*b*, at holes 5*a* and 6*b* and at 10*a* and 12*b*.

Figure 4:
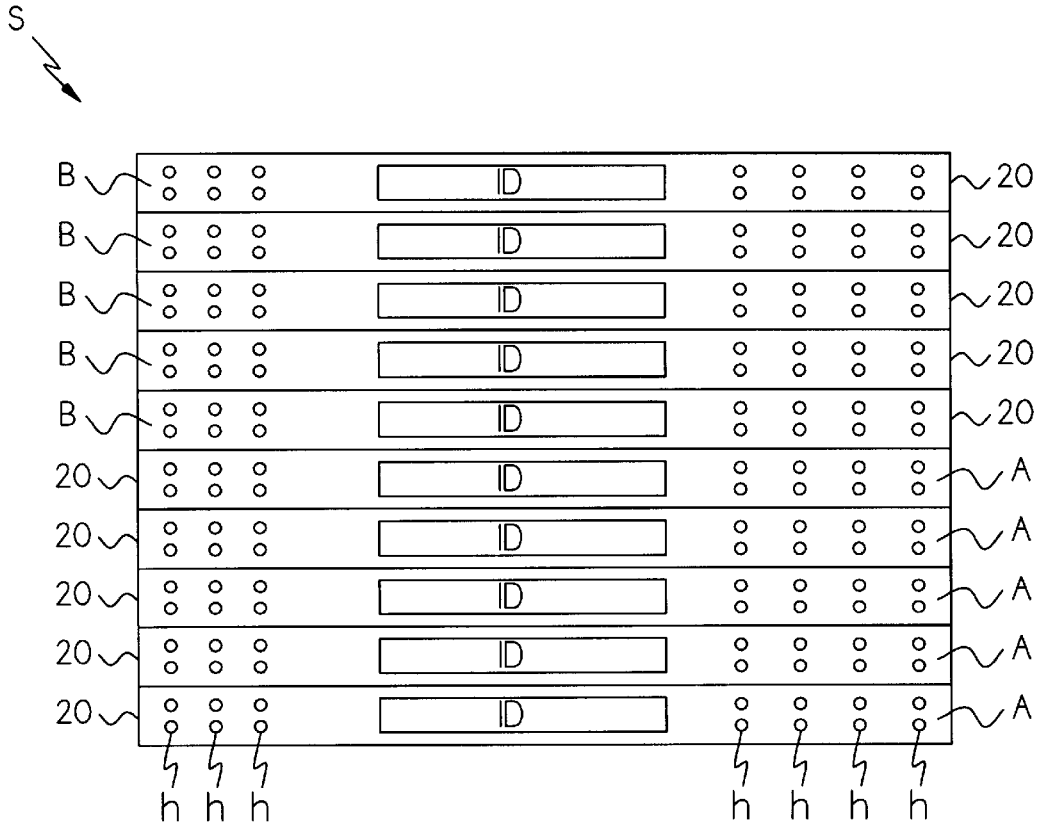
FIG. 4 is a schematic view in plan illustrating a preformed sheet of bands in which multiple parallel holes are used at each end of the band.

Referring to FIG. 4 there is shown a sheet of material S scored for division into a number of bands 20. At each end of the bands 20 are two parallel rows of holes h. By using holes in pairs, the attachment of the band 20 will be more secure since a pair of holes on end A can be aligned with a pair of holes B on the other end of the band thus doubling the security of the band from accidental or purposeful removal.

Figure 5:
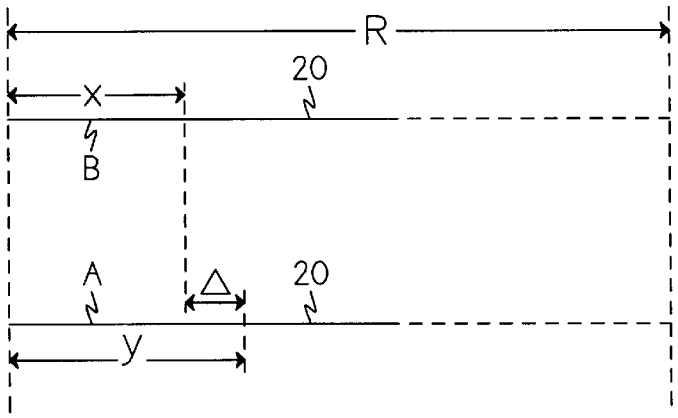
FIG. 5 is a sketch illustrating the basic geometry of a band of indeterminate length made in accordance with this invention.

Referring to FIG. 5, the mathematical relationships established between the several elements of a band 20 designed in accordance with the invention is illustrated. The dotted horizontal lines represent a band 20 of indeterminate length.

a. R=to the repeat distance b. x=the distance between the holes on end B of the band 20 c. y=the distance between the holes on the end A of the band 20 d. $y=x+\Delta$ where Δ is the incremental adjustment that can be made in C, the circumference e. n=the number of holes in a repeat unit R at the end A of the band 20 f. n+1=the number of holes in a repeat unit R at the first end B of the band 20 g. $R=y(n)$ and also $R=x(n+1)$ h. then $x(n)=y(n-1)$ and, substituting for y, i. $xn=(x+\Delta)(n-1)$ j. $xn=xn+\Delta n-\Delta-x$; and, solving for x k. $x=\Delta n-\Delta$; or l. $\Delta n=x+\Delta$ m. $n=(x+\Delta)/\Delta$ and, finally:

n. $n=x/\Delta+1$.

By substituting values in the foregoing equations a band may be designed by selecting the minimal circumferential adjustment Δ and the minimum spacing desired between the holes on the end B of the band. For example the following relationships can be developed.

| x | Δ | n | y | R |
|---|---|---|---|---|
| ½ | ¼ | 3 | ¾ | 1½ |
| ⅜ | ⅛ | 4 | ½ | 2 |
| ½ | ⅛ | 5 | ⅝ | 2½ |
| ⅝ | ⅛ | 6 | ¾ | 3¾ |
| 1 | ⅛ | 9 | 1⅛ | 9 |

The above are listed in units without dimensions but are of practical use in designing a band of the invention if they were considered to be in inches.

I claim:

1. An elongated thin band of tough flexible material adapted to be secured in surrounding relationship to an object, the band including a first end that has three or more equally spaced apart holes, a second end that includes three or more equally spaced apart holes, a display area located between the spaced apart holes on the first end and the spaced apart holes on the second end and indicia on the display area, at least one hole on the first end of the band adapted to be aligned with at least one hole on the second end of the band when the band is positioned in surrounding relationship to the object, and a fastening means adapted to pass through and secure the aligned holes relative to each other, wherein the equally spaced apart holes on the first free end of the band are spaced apart at a distance different from the spacing on the equally spaced apart holes on the second free end of the band.

2. A band according to claim 1 wherein the fastening means requires destructive removal.

3. A band according to claim 1 wherein there are at least two paired parallel rows of spaced apart holes on the first and second ends of the band.

4. A band according to claim 1 wherein at least two spaced apart holes on the first free end of the band are adapted to be aligned over at least two spaced apart holes on the second free end of the band and each pair of aligned holes is secured relative to each other.

* * * * *